United States Patent [19]

Baugh et al.

[11] Patent Number: 4,848,469

[45] Date of Patent: Jul. 18, 1989

[54] LINER SETTING TOOL AND METHOD

[75] Inventors: J. Lindley Baugh, Houston; James M. Fraser, III, Spring; George J. Melenyzer, Humble, all of Tex.

[73] Assignee: Baker Hughes Incorporated, Houston, Tex.

[21] Appl. No.: 206,807

[22] Filed: Jun. 15, 1988

[51] Int. Cl.[4] ..... E21B 23/02

[52] U.S. Cl. ..... 166/382; 166/123; 166/208

[58] Field of Search ..... 166/123, 125, 181, 208, 166/216, 242, 382

[56] References Cited

U.S. PATENT DOCUMENTS

| | | | |
|---|---|---|---|
| 4,051,896 | 10/1977 | Amanchala et al. | 166/123 |
| 4,598,774 | 7/1986 | Neuels et al. | 166/382 |
| 4,688,642 | 8/1987 | Baker | 166/382 |

*Primary Examiner*—William P. Neuder

*Attorney, Agent, or Firm*—Hubbard, Thurman, Turner & Tucker

[57] ABSTRACT

An improved setting tool is provided for positioning, setting, and releasing a liner in a subterranean wellbore. The setting tool includes a plurality of fingers, each biased for locking engagement with axially spaced recesses provided in the wall of the tool mandrel axially above a lowermost position of the liner hanger connecting nut. The fingers are automatically forced upward into a release position when interference rollers move radially out of their respective recesses and separate a plurality of axially movable sleeves. Premature release of the liner is avoided by positioning the recesses in the mandrel such that the fingers are in a lock position when the tool string is either in tension or compression. The liner can be rotated after setting the liner hanger, so that the setting tool and drill string can thereafter be reliably retrieved by simple axial pick-up.

20 Claims, 4 Drawing Sheets

LINER SETTING TOOL AND METHOD

FIELD OF THE INVENTION

Present invention relates to devices and methods for positioning, setting, and releasing a downhole tool, and more particularly, to setting tools of the type which prevent premature or unintentional release of a liner hanger or similar mechanically set tool in a subterranean wellbore.

BACKGROUND OF THE INVENTION

A liner is a length of tubular suspended in a wellbore, and which normally does not extend to the surface. In exemplary applications, liners are used to repair damaged casing strings, or to test questionable production zones. A liner hanger secures the liner within the well bore, and typically includes radially movably slips with teeth for biting engagement with the outer casing or sides of the "open hole" bore. The liner may be mechanically "set" in the well by axially moving the drill string with respect to the slips, thereby forcing the teeth radially outward into biting engagement with the casing.

A liner setting tool is conventionally placed on the drill string axially above the liner hanger, and assists in setting the liner hanger. Once the liner hanger has been set, the liner setting tool can be released from the liner hanger by rotating the drill string. Most importantly, the setting tool should allow for the quick yet reliable disengagement of the liner hanger, so that the setting tool and drill string can be retrieved to the surface, leaving the hanger and liner fixedly positioned in the well bore. In certain applications, e.g., when cementing a liner in place, it is preferable that the liner hanger be set and the setting tool structurally be disengaged from the liner hanger, while thereafter still employing the setting tool for rotating the drill string.

A significant problem with many prior art liner setting tools is that the liner hanger may be prematurely or inadvertently released from the setting tool during the process of positioning the equipment at its desired depth in the wellbore. A liner may, for example, be 100 feet or more in length and have a diameter only slightly less than the downhole casing through which it passes. If the wellbore is vertical and the liner diameter is substantially less than the downhole casing diameter, the entire drill string may remain in tension while lowering the equipment in place due to the weight of the drill string and liner, in which case premature release of the liner hanger may not be a problem. If, however, the well bore is highly deviated or perhaps has substantially horizontal portions, or if the liner or liner hanger gets "stuck" in a casing only slightly larger in diameter than the liner hanger, the drill string is frequently used to "push" the setting tool, liner hanger, and the liner through the well bore. In this case, axial movement of the drill string with respect to the liner hanger is possible, so that premature unlocking of the setting tool may occur. Moreover, the accidental unlocking of the setting tool may not be known to operators at the surface, who may then attempt rotate the drill string to free the presumed "hang-up". This action, in turn, may cause the inadvertent release of a liner hanger from the setting tool, thereby necessitating a more costly retrieval operation.

One type of prior art liner assembly, hereinafter referred to as the TIW RRP liner assembly, includes an elongate setting collar with an upper spline receiving section and a lower spline receiving section. The drill string above and below the setting tool includes an upper spline and a lower spline, with the connecting nut of the setting tool being axially spaced between the splines. The lower spline may be engaged to rotate the liner prior to setting of the liner hanger. The upper spline may be engaged to rotate the liner subsequent to releasing the hanger from the setting tool nut.

Engagement of one of the splines in the TIW RRP assembly would also prevent inadvertent separation of the setting tool and liner hanger while the assembly was being positioned in the wellbore. This equipment has, however, significant drawbacks over other liner hanger setting equipment. The spline arrangement and setting collar are expensive to manufacture. To rotate the liner after setting the liner hanger, the upper spline must be properly aligned to mate with the upper spline receiving section of the setting collar. If a liner is to be reset in a well,the tubing string must be carefully manipulated so that the lower and upper splines pass through their respective sections of the setting collar. The splines may become damaged or their ends deformed by the "blind" attempt to align these components, so that the desired liner rotation or resetting operation can thereafter not be successfully accomplished. Lastly, rotation of the setting tool and drill string subsequent to the setting of the liner hanger requires that the lower spline be pulled upward through the lower spline receiving section of the setting collar in order to retrieve the setting tool. Dogs on the lower spline may be spring biased to quickly pass by the lower spline receiving section, but the dogs can become locked or jammed in a fully or partially extended position. In this case, the drill string must be rotated so that the dogs are in alignment with the spline receiving portion, so that the lower spline can pass upwards for retrieval. This latter operation, which takes time and patience, conflicts wih the operator's desire to quickly retrieve the setting tool after cementing is complete to insure that the setting tool and drill string do not become stuck in a cemented wellbore.

The disadvantages of the prior art are overcome by the present invention, and an improved setting tool and method of setting a liner or other downhole tool are hereinafter disclosed.

SUMMARY OF THE INVENTION

The improved setting tool includes a cylindrical mandrel having a plurality of upper recesses and a plurality of lower recesses, each with cam or ramp surfaces. A torque control ring assembly and a liner hanger connection nut are each positioned about and are axially movable with respect to the mandrel for reciprocating motion during the liner hanger setting operation. The torque control ring assembly includes a plurality of downwardly projecting fingers, each biased downward for engagement with corresponding slots in the hanger. The fingers are forced upward with respect to torque control ring by the axial separation of sleeves, which in turn is caused by radial movement of interference rollers as they ride out of the recesses along the cam surfaces.

During "run-in" of the tool to position the liner hanger in the well, the fingers are locked for engagement with the slots in the liner hanger while interference rollers are within one of the upper or lower recesses in the mandrel. The recesses are axially positioned such that the upper recesses lock the fingers in engagement with the liner hanger when the drill string is in compression, and the lower recesses rotatably lock the setting tool and liner hanger while the drill string is in tension. Inadvertent separation of the liner hanger and setting tool are thus avoided, since the drill string is generally either in tension or in compression if a tool becomes stuck in a well.

To release the setting tool from a set liner hanger, the drill stem is reciprocated so that the interference rollers are axially positioned between the upper and lower recesses, thereby raising the fingers to the release position. The drill string is then rotated, unthreading the setting tool liner hanger connection nut beneath the fingers from the liner hanger. Thereafter, the fingers may still be brought into engagement with the respective slots in the liner hanger to allow rotation of the liner during the cementing operation. In order to thereafter retrieve the setting tool and the drill string, the operator need only "pickup" on the drill string.

It is an object of the present invention to provide a reliable setting tool for assisting in the mechanical setting of a downhole tool by reciprocating the tubular string, wherein the setting tool is adapted for rotation of the tubular string to release the setting tool from the downhole tool.

It is another object of the invention to provide a setting tool which will be automatically locked to the downhole tool while the tubular string is either in tension or compression, and which includes all retrievable locking member components axially spaced above a lowermost position of the threaded nut of the setting tool, which interconnects the setting tool and the downhole tool.

The features of the present invention may be utilized in a liner setting tool which includes downwardly projecting fingers adapted for engagement within slots in a liner hanger to enable rotation of the setting tool to rotate the liner either prior or subsequent to setting of the liner hanger. The fingers are preferably biased for engagement toward the slots, such that rotation of the setting tool axially coupled to the liner hanger automatically engages the fingers within the slots to allow rotation of the liner with the setting tool.

An advantage of the present invention is that a downhole liner hanger adapted for mechanical setting in a wellbore may be reliably locked to its setting tool while the tool string is either in tension or compression. After the liner hanger is set in the well and the setting tool is rotated to become mechanically released from the liner hanger, the setting tool and drill string may thereafter be picked up for retrieval to the surface without risking the re-engagement of the components which previously locked the setting tool and liner hanger together.

These and further objects, features, and advantages of the present invention become from the following detailed description, wherein reference is made to the figures in the accompanying drawings.

DETAILED DESCRIPTION OF THE PREFERRED EMBODIMENTS

Figure 1:
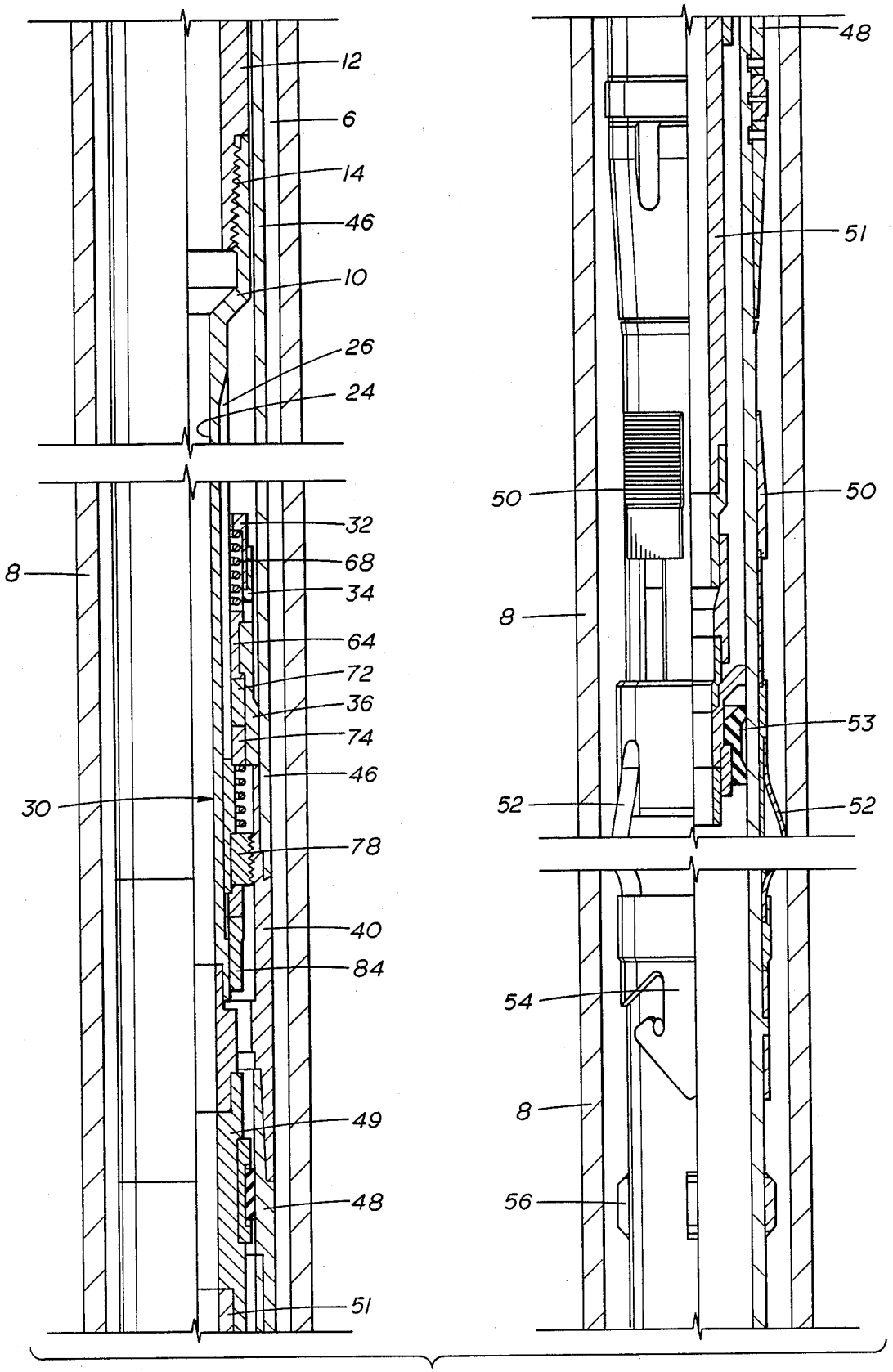
FIG. 1 is a simplified vertical half-sectional view of a portion of the drill string which includes a setting tool according to the present invention and portions of a suitable liner hanger and liner.

Referring to FIG. 1, the setting tool of the present invention is generally depicted in a suitable environment for setting a liner hanger in a subterranean well bore. The well bore 6 shown in FIG. 1 is defined by a conventional casing 8, although it should be understood that the concepts of the present invention are applicable for setting liner hangers in both cased and uncased or "open hole" wells.

A tubular setting mandrel 10 is threadably connected to a conventional drill pipe 12 at threads 14. Cylindrical interior diameter 24 of the mandrel 10 defines a central passageway through the mandrel. A setting ring assembly 30 which includes a spring retainer 32, spring 68, torque finger retainer 64, torque control ring 34, sleeves 72, 74, and torque fingers 36 is axially movable along mandrel 10, but is fixed against rotation (as explained subsequently) by keyways 26. A nut 78 is also axially movable and rotatably fixed to mandrel 10. The nut 78 is positioned axially below assembly 30, and threadably interconnects the mandrel 10 to liner hanger sleeve 40. The nut 78 as shown in FIG. 1 in its lower most position, with key cover ring 80 in engagement with lower connection 84.

A liner setting sleeve extension 46 is threadably connected to liner hanger setting sleeve 40, and projects upwardly therefrom. A liner hanger 48 may be connected to the lower end of sleeve 40, and supports a plurality of slips 50 for biting engagement with the casing 8, a centralizer 56, a J-slot arrangement 54, and a plurality of drag springs 52. If desired, a section of liner (not shown) may be connected to the hanger 48 beneath the centralizers 56 in conventional fashion. Mandrel 10 is connected at its lower end to a packoff member 49, a setting tool swivel 51, and a wiper plug 53. The liner, liner hanger, slips, centralizer, J-slot arrangement, drag springs, packoff member, setting tool swivel, and wiper plug are each conventional in the industry, and are generally illustrated to show a suitable environment and to assist in describing the method of the present invention.

Figure 2:
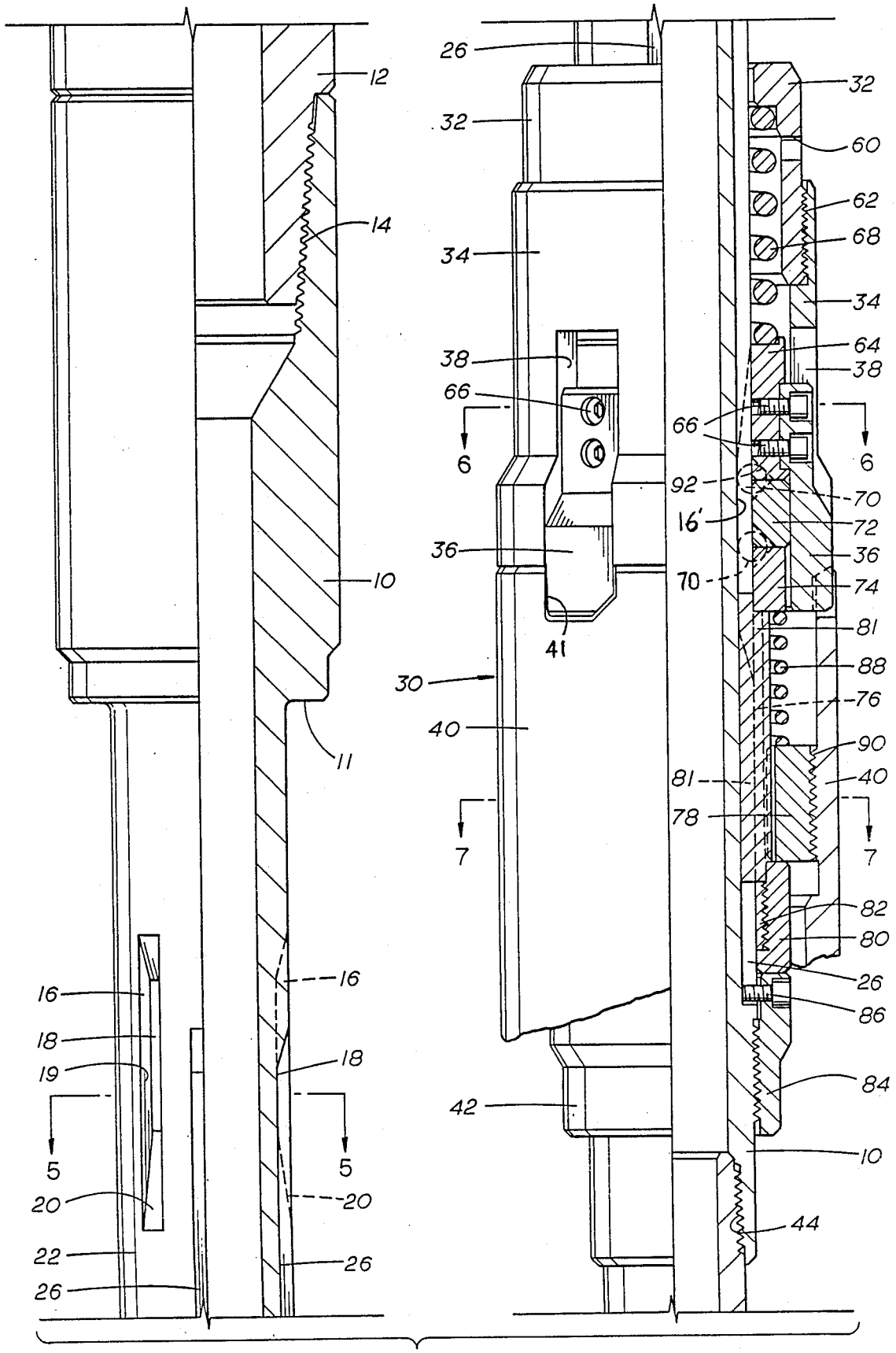
FIG. 2 is a half-sectional view of a setting tool generally shown in FIG. 1 in locked engagement with a portion of the liner hanger.
Figure 5:
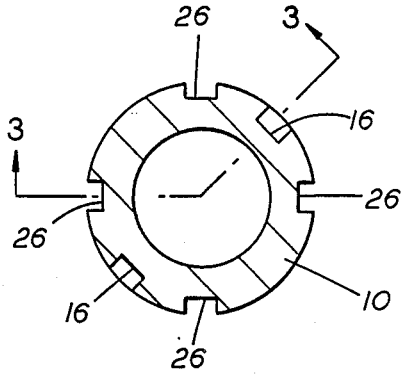
FIGS. 5, 6 and 7 are cross-sectional views of the liner setting tool shown in FIG. 2.

Referring now to FIG. 2, mandrel 10 is shown connected to drill pipe 12 at threads 14. The intermediate portion of the elongate mandrel has been deleted from FIG. 2, and it should be understood that the mandrel 10 typically is approximately 3 feet or more in length. Four elongate keyways or slots 26 are circumferentially spaced at 90° intervals about the mandrel, and extend from an upper portion to a lower portion of the mandrel, as shown. Two upper recesses 16 are circumferentially spaced at 180° apart about the upper portion of the mandrel are provided for cooperating with the setting ring assembly, as described subsequently, and two similar lower recesses 16' are also depicted. (FIG. 2 should thus be understood as being schematic, in that the cross-sectional half shows both a slot and an upper and lower recess, although these components are circumferentially spaced, as shown in FIG. 5.) Each recess 16 or 16' has a substantially planar base surface 18, a cam or ramp surface 20 interconnecting the base surface 18 with the outer cylindrical surface 22 of the mandrel 10, and a pair of substantially parallel side surfaces 19. As explained subsequently, rollers move radially inward or outward as they travel axially along each of the ramp surfaces 20, and thereby move the fingers 36 axially into and out of position for engagement with the liner hanger setting sleeve 40. FIG. 5 illustrates the circumferential spacing of the keyways 26 in the mandrel 10, and also illustrates the upper two circumferentially spaced recesses 16. It should be understood that although at least two keyways 26 and two recesses 16 are preferably provided in the mandrel 10, any number of keyways and upper and lower recesses may be provided.

Torque control ring 34 has three circumferentially spaced fingers 36 slidably positioned in slots 38 therein, so that each finger 36 may move axially with respect to ring 34. The fingers 36, in turn, are each fixed to finger retainer 64 by bolts 66. Finger retainer 64 is biased downwardly by spring 68, which is then held in place by spring retainer 32 threadably connected to 34 at 62. Slots 38 in ring 34 and ports 60 in retainer 32 allow for fluid communication between the spring 68 and the sleeve 46 (see FIG. 1). Sleeve 72 is shown in engagement with both finger retainer 64 and sleeve 74, so that the fingers 36 are in their downward position for engagement with upwardly opening slots or stop surfaces on the top of liner hanger sleeve 40. In this position, each of the rollers 70 is within a corresponding one of the lower recesses 16', and is positioned between the base 18 of its recess and a pair of angled surfaces 92, formed by the ends of the members 64, 72, and 74.

The nut 78 is positioned axially below the setting ring assembly 30, and is axially below the lower plurality of recesses 16 when the nut 78 is in its lowermost position with cover 80 in engagement with bottom connection 84, which in turn is secured to the mandrel by threads and bolts 86. Keys 81 and sleeve 82 cooperate with keyways 26 to allow the nut 78 and the setting ring assembly 30 to move axially with respect to the mandrel 10, but prohibit the nut 78 and assembly 30 from rotation in either direction with respect to the mandrel 10. Nut 78 has left-hand threads 90 intended for mating engagement with threads on the liner setting sleeve 40, and thus interconnects the mandrel and the liner hanger.

When the setting assembly is in the position as shown in FIG. 2, the tool string is in tension, and the torque control ring and liner hanger are rotatably locked together by fingers 36. The mandrel 10 and the liner hanger setting sleeve 40 are interconnected by nut 78, so that rotation of the drill stem rotates the nut and the assembly 30, which rotates the liner hanger setting sleeve 40 simultaneously with the nut 78. Accordingly, rotation of the drill string in either direction will not unthread the liner hanger setting sleeve 40 from the nut 78 as long as the fingers 36 are locked to the liner hanger setting sleeve, as shown in FIG. 2.

Figure 3:
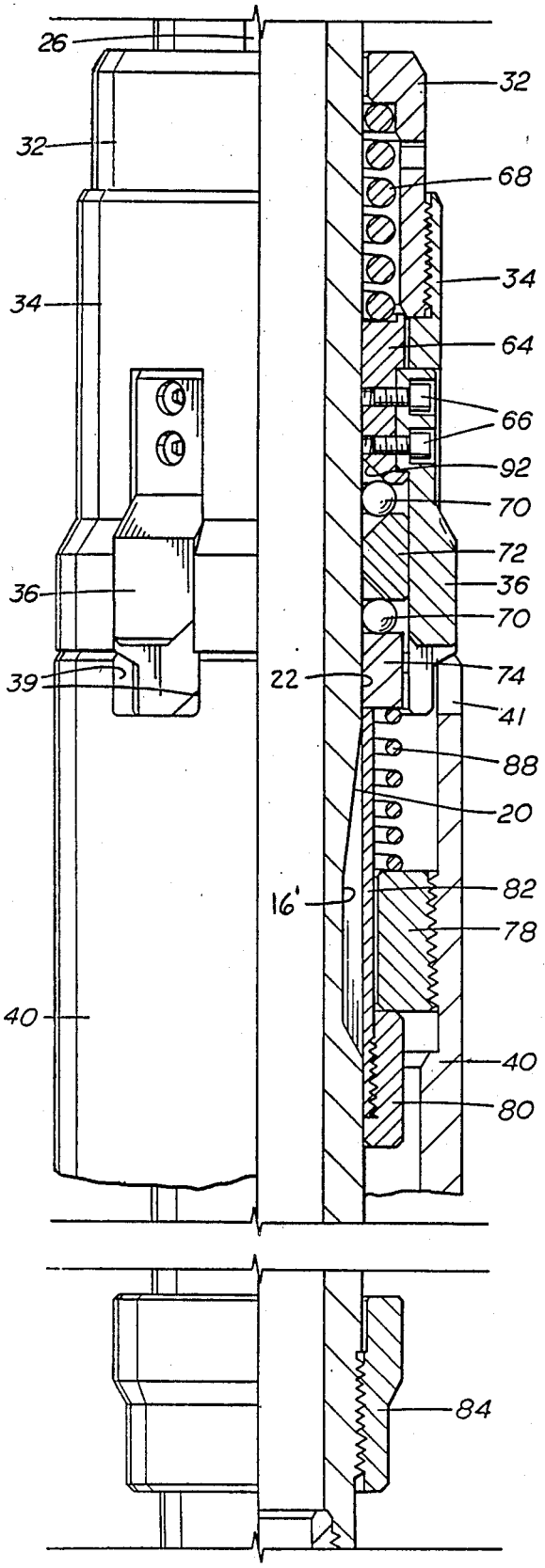
FIG. 3 is a half-sectional view along the line as as shown in FIG. 5 of the setting tool shown in FIG. 2 in a position rotatably released from and interconnected with the liner hanger.

Lowering of the drill string with respect to the slips 50 (as explained subsequently), allows the liner setting assembly to move into position as shown in FIG. 3. The rollers 70 have ridden up the ramp surfaces 20 of each lower recess 16', and are in engagement with the outer cylindrical surface 22 of the mandrel. The taper of the ramp surfaces 20 may be altered to obtain the desired radial force in response to a selected or presumed axial force, and preferably will be approximately 10° from the central axis of the mandrel 10. This radial force, in turn, causes axial separation between sleeves 72 and 74, and between the sleeve 74 and the finger retainer 64, thereby compressing spring 68. Accordingly, each of the plurality of fingers 36 is moved axially upward approximately one-inch with respect to the torque control ring 34, so that the fingers 36 no longer engage the side surfaces 39 of the slots 41. This same lowering action of the mandrel causes axial separation between the key cover ring 80 and the bottom connector 84, as shown.

Figure 4:
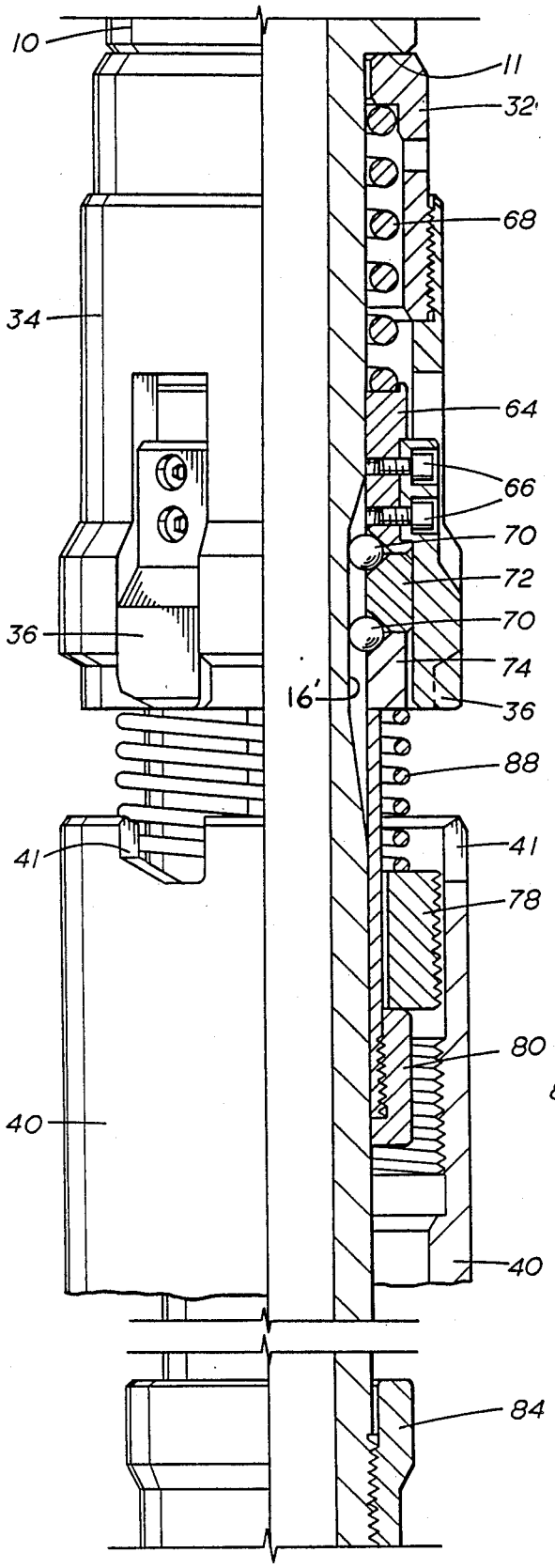
FIG. 4 is a half-sectional view along the line as shown in FIG. 5 of the setting tool shown in FIG. 2 in a liner hanger released position.
Figure 6:
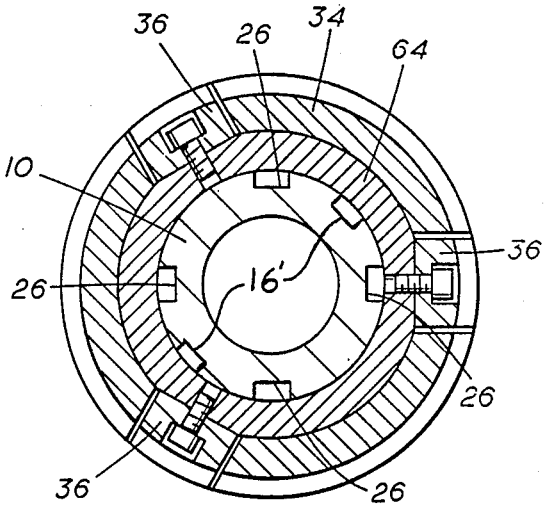
Figure 7:
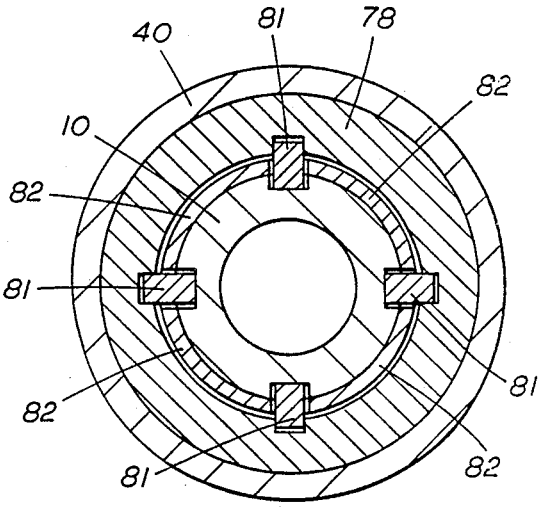

With the setting assembly in position as shown in FIG. 3 and with the liner hanger axially secured to the casing, the drill string may be rotated to unthread the nut 78 from the liner hanger sleeve 40, thereby moving the nut to the position as shown in FIG. 4. (The liner hanger may include a bearing assembly which allows the liner to be rotated after the liner hanger is set in the well bore, although the torque required to rotate the set liner is substantially less than that necessary to unthread the nut 78 from the sleeve 40.) In this position, mandrel 10 is structurally disconnected from the liner hanger 40, and accordingly the setting assembly may be retrieved to the surface by simply raising the drill string 10.

A typical liner setting operation will now be described. A liner, liner hanger, and setting assembly will be lowered from the drill string into the well, with the tool string generally in tension due to the weight of these components, and the rollers 70 thus positioned within the corresponding lower recesses 16' of the mandrel. If the liner hanger should, however, get stuck while in the well bore, the tool string can be pushed into compression without concern for unthreading the liner hanger from the setting tool, since the mandrel 10 will move axially so that the rollers 70 move from the lower recesses 16' to the corresponding upper recesses 16 in the upper portion of the mandrel. Thus, when the tool string is in compression, retainer ring 32 is closely adjacent the shoulder surface 11 of the mandrel 10, and the fingers 36 are again in their downward position, engaging slots 41 of mandrel setting sleeve 40. When the tool string is thus either in tension or compression, the rollers 70 are disposed within one of the recesses 16 or 16', the fingers 36 rotatably lock the mandrel 10, and thus the nut 78 to the liner hanger setting sleeve 40, and the nut 78 cannot be unthreaded from the liner hanger setting sleeve 40.

When the liner is at its desired position within the well bore, the tool may be picked up and rotated in conventional fashion to disengage the J-slot arrangement 54. Thereafter, the operator can "set down" on the tool string, thereby moving the mandrel 10 downward to force the slips 50 radially outward into biting engagement with the casing 8. During this setting operation, centralizer 56 keeps the tool string generally centered within the casing, and the drag springs 52 provide sufficient resistence to allow the desired stroke between these components to set the liner hanger in the well bore.

This setdown operation will both bring the slips 50 into biting engagement with the casing 8, and will move the rollers 70 from the position as shown in FIG. 2 to a position wherein the rollers are in engagement with the outer cylindrical surface of the mandrel 10, as shown in FIG. 3. In other words, the liner hanger setting operation will automatically move the rollers 70 to an axial position between the upper recesses 16 and the lower recesses 16', and the fingers 36 will then automatically be in the raised position relative to slots 41 in liner hanger setting sleeve 40 as shown in FIG. 3. While, in this position, as explained above, the drill string 12 may be rotated to allow the nut 78 to unthread from the liner setting apparatus.

Once the mandrel 10 and the liner hanger 40 have been unthreaded and thus structurally disconnected, the tool string may be set down until the rollers 70 are in the upper recesses 16 (see FIG. 4), in which case the fingers 36 will be in their downward position with respect to the locking ring 34. With the fingers in this position, the drill string and thus the assembly 30 may be lowered so that the fingers 36 re-engage the slots 41 in the liner setting sleeve 40, thereby enabling rotation of the drill string to cause simultaneous rotation of the liner setting hanger sleeve 40 after the nut 78 has been disconnected from the liner hanger. The biasing force of springs 78 enables the setting assembly 30 to be axially lowered so that the fingers 36 would be positioned within the slots 41, but would be moved upwardly to compress the spring if the fingers are not rotatably aligned with the slots 41. The drill string may then be rotated so that the fingers snap into place when rotationally aligned with the slots: Again, the liner setting apparatus may be easily and quickly retrieved to the surface by simply raising up on the drill pipe 12.

Various modifications to the liner setting tool will be suggested by the above description. Rollers are preferred for engagement with the ramp surfaces to provide a large area of engagement, although hardened balls or other radially shiftable actuating members could be used instead of rollers. The term "drill string" as used herein should be understood to include various tubular members used in petroleum recovery operations, including drill pipe, tubing and casing.

The setting tool of the present invention may also be employed to assist in setting a downhole tool other than a liner hanger using the axial movement of the mandrel with respect to the tool to set the tool in the well bore, then unthreading the setting tool from the downhole tool. The setting tool may, for example, be used to fix a mechanically set packer in a well bore, and then the drill string rotated to unthread the setting tool from the packer, as described above.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. Liner setting apparatus for setting a liner suspended from a tubular string in a subterranean well and for releasing from a set liner hanger to permit retrieval of the liner setting apparatus and the tubular string, the liner hanger including (a) gripping members for bitting engagement with side walls of the wellbore in response to axial movement of the tubular string, the liner setting apparatus, and the liner within the well bore, and (c) interior threads for threaded engagement and disengagement with the liner setting apparatus, the liner setting apparatus comprising:

a tubular mandrel adapted at its upper and lower ends for affixing to respective upper and lower sections of the tubular string, and including a plurality of locking recesses each at a selected axial position along the tuular mandrel, each locking recess defining a ramp surface between a base of each recess and an outer cylindrical surface of the tubular mandrel;

a nut positioned about the tubular mandrel and fixed against rotation with respect to the tubular mandrel, the nut having exterior threads for mating engagement with the interior threads of the liner hanger;

a setting ring assembly positioned about the tubular mandrel and axially spaced between the nut and the upper end of the tubular mandrel and axially movable with respect to the tubular mandrel between a lock position axially adjacent one or more of the plurality of locking recesses to an unlock position axially spaced from the plurality of locking recesses, the setting ring assembly including:

(a) an annular torque control ring, (b) one or more fingers each axially movable with respect to the torque control ring between a lock position such that each of the fingers is axially positioned with respect to the torque control ring for engagement with the stop surfaces of the liner hanger, and an unlock position such that each of fingers is axially positioned with respect to the torque control ring for non-engagement with the stop surfaces of the liner hanger, (c) a plurality of sleeves each positioned about the tubular mandrel and axially movable with respect to the torque control ring and with respect to each other, each of the one or more finges being affixed to one of the plurality of sleeves, and (d) an actuating member radially moveable from a lock position such that the actuating member is within one of the plurality of locking recesses and said locking sleeves are axially adjacent each other, to an unlock position such that the actuating member is moved radially outwardly by engagement with the ramp surface during axial movement of the annular setting ring assembly, such that the actuating member separates the sleeves axially during radially outward movement thereof and thereby axially moves each of the one or more fingers to the unlock position.

2. The liner setting apparatus as defined in claim 1, wherein the nut is axially moveable with respect to the tubular mandrel, and the annular torque control ring is fixed against rotation with respect to the tubular mandrel.

3. The liner setting apparatus as defined in claim 1, further comprising:

a spring for biasing the plurality of sleeves to a position axially adjacent each other.

4. The liner setting apparatus as defined in claim 2, wherein the plurality of locking recesses comprise:

a first plurality of recesses each spaced adjacent the upper end of the tubular mandrel for locking together the liner setting apparatus and the liner hanger when the tubular string is in compression; and a second plurality of locking recesses each adjacent the lower end of the tubular mandrel for locking together the liner setting apparatus and the liner hanger when the tubular string is in tension.

5. The liner setting apparatus as defined in claim 4, wherein said plurality of actuating members each provide locking engagement with a respective one of the first plurality of recesses when the tubular string is in tension and with a respective one of the second plurality of recesses when the tubular string is in compression.

6. The liner setting apparatus as defined in claim 4, wherein each of said first and second plurality of locking recesses are positioned axially above a lowermost position of the nut with respect to the tubular mandrel.

7. The liner setting apparatus as defined in claim 1, wherein each of the plurality of ramp surfaces is inclined at an angle of less than 10 degrees with respect to a central axis of the tubular mandrel.

8. The liner setting apparatus as defined in claim 1, wherein said actuating member is a metal roller for rolling engagement on the ramp surface.

9. Setting apparatus for setting a tool suspended from a tubular string in a subterranean well and for releasing from a set tool to permit retrieval of the setting apparatus and the tubular string, the tool including (a) gripping members for biting engagement with side walls of the well-bore in response to axial movement of the tubular string, (b) stop surfaces for engagement with the setting apparatus to permit simultaneous rotation of the tubular string and the tool within the wellbore, and (c) interior threads for threaded engagement and disengagement with the setting apparatus, the setting apparatus comprising:

a tubular mandrel including a plurality of locking recesses each at a selected axial position along the tubular mandrel, each locking recess defining a ramp surface between a base of each recess and an outer cylindrical surface o the tubular mandrel;

a nut positioned about and axially movable with respect to the tubular mandrel and fixed against rotation with respect to the tubular mandrel, the nut having exterior threads for mating engagement with the interior threads of the tool;

a setting ring assembly positioned about the tubular mandrel and axially spaced between the nut and the upper end of the tubular mandrel and axially movable with respect to the tubular mandrel between a lock position axially adjacent one or more of the plurality of locking recesses to an unlock position axially spaced from the plurality of locking recesses, the setting ring assembly including (a) an anular torque control ring fixed against rotation with respect to the tubular mandrel, (b) one or more fingers each axially movable with respect to the torque control ring between a lock position such that each of the fingers is axially positioned with respect to the torque control ring for engagement with the stop surfaces of the tool, and an unlock position such that each of the fingers is axially positioned with respect to the torque control ring for non-engagement with the stop surfaces of the liner tool, (c) a plurality of sleeves each positioned about the tubular mandrel and axially movable with respect to the torque control ring and with respect to each other, each of the one or more fingers being affixed to one of the plurality of sleeves, and (d) an actuating member radially moveable from a lock position such that the actuating member is within one of the plurality of locking recesses and said locking sleeves are axially adjacent each other, to an unlock position such that the actuating member is moved radially outwardly by engagement with the ramp surface during axial movement of the annular setting ring assembly, such that the actuating member separates the sleeves axially during radially outward movement thereof and thereby moves each of the one or more fingers to the unlock position.

10. The setting apparatus as defined in claim 9, further comprising:

a spring for biasing the plurality of sleeves to a position axially adjacent each other.

11. The setting apparatus as defined in claim 9, wherein the plurality of locking recesses comprise a first plurality of recesses each spaced adjacent the upper end of the tubular mandrel for locking together the setting apparatus and the tool when the tubular string is in compression; and a second plurality of locking recesses each adjacent the lower end of the tubular mandrel for locking together the liner setting apparatus and the tool when the tubular string is in tension.

12. The setting apparatus as defined in claim 11, wherein a plurality of actuating members each provide locking engagement with a respective one of the first plurality of recesses when the tubular string is in tension and with a respective one of the second plurality of recesses when the tubular string is in compression.

13. The liner setting apparatus as defined in claim 1, wherein:

each of the plurality of ramp surfaces is inclined at an angle of less than 10 degrees with respect to a central axis of the tubular mandrel; and the actuating member is a metal roller for rolling engagement on the ramp surface.

14. A method of setting a liner suspended from a tubular string in a subterranean well and for releasing from a set liner hanger to permit retrieval of a liner setting apparatus and the tubular string, a liner hanger including (a) gripping members for biting engagement with sidewalls of a well bore (b) stop surfaces for engagement with the liner setting apparatus, and (c) interior threads for threaded engagement and disengagement with the liner setting apparatus, the method comprising:

providing a tubular mandrel along the tubular string axially above the liner setting apparatus, the tubular mandrel including a plurality of locking recesses each at a selected axial positiôn along the tubular mandrel, each locking recess defining a ramp surface between a base of each recess and an outer cylindrical surface of the tubular mandrel;

providing a nut about the tubular mandrel fixed against rotation and axially movable with respect to the tubular mandrel, the nut having exterior threads for mating engagement with the interior threads of the liner hanger;

providing an annular torque control ring axially between the nut and an upper end of the tubular mandrel;

movably mounting a plurality of sleeves to the tubular mandrel each axially movable with respect to the torque control ring and with respect to each other;

fixably mounting one or more fingers to one of the plurality of sleeves, such that each of the one or more fingers is axially movable with respect to the torque control ring between a locked position and an unlocked position;

providing a radially movable actuating member axially between the plurality of sleeves and positionable within a selected one of the plurality of locking recesses;

lowering the liner setting apparatus, the liner hanger, and the liner into a well bore while suspended from the tubular string, such that the tubular mandrel is rotatably locked to the liner setting apparatus when the tubular string is in tension and the actuating member is within a lower one of the plurality of locking recesses, and when the tubular string is in compression when the interference member is in an upper one of the plurality of locking recesses;

axially lowering the tubular string and the tubular mandrel with respect to the gripping member to move the gripping member radially outward and into biting engagement with the sidewalls of the borehole and simultaneously to automatically move the actuating member between the upper and lower recesses to release the locked rotational connection between the liner hanger and the liner setting apparatus;

rotating the drill string to unthread the nut from the liner setting apparatus; and raising the drill string and liner setting apparatus to the surface.

15. The method defined in claim 14, further comprising:

axially moving the tubular string so as to position the actuating member in one of the plurality of recesses after the nut has been unthreaded from the liner setting apparatus, thereby axially moving the one or more fingers to the locked position;

rotating the tubular string and the tubular mandrel to simultaneously rotate the liner by engagement of the one or more fingers with the stop surfaces of the liner setting apparatus while the nut is unthreaded from the liner setting apparatus.

16. The method as defined in claim 15, wherein the tubular string is axially moved so that the actuating member is within the upper recess of the tubular mandrel when the liner is rotated after the nut has been released from the liner setting apparatus.

17. The method as defined in claim 14, further comprising:

biasing the plurality of sleeves to position axially adjacent each other.

18. The method as defined in claim 14, further comprising:

providing a first plurality of recesses adjacent the upper end of the tubular mandrel;

providing a second plurality of recesses adjacent a lower end of the tubular mandrel;

providing a plurality of actuating members each for locking engagement with a respective one of the first plurality of recesses when the tubular string is in tension or with a respective one of the second plurality of recesses when the tubular string is in compression.

19. The method as defined in claim 14, wherein each of the plurality of ramp surfaces is inclined at an angle of less than 10° with respect to a central axis of the tubular mandrel.

20. The method as defined in claim 18, wherein each of the plurality of actuating members is a metal roller for rolling engagement with the ramp surface.

* * * * *